US008198792B2

(12) United States Patent
Tsuzuki et al.

(10) Patent No.: US 8,198,792 B2
(45) Date of Patent: Jun. 12, 2012

(54) ELECTRODELESS DISCHARGE LAMP, LIGHTING FIXTURE, AND METHOD FOR MANUFACTURING ELECTRODELESS DISCHARGE LAMP

(75) Inventors: Yoshinori Tsuzuki, Osaka (JP); Kazuhiko Sakai, Osaka (JP); Kohji Hiramatsu, Neyagawa (JP); Atsunori Okada, Toyonaka (JP)

(73) Assignee: Panasonic Corporation, Kadoma-Shi, Osaka (JP)

( * ) Notice: Subject to any disclaimer, the term of this patent is extended or adjusted under 35 U.S.C. 154(b) by 329 days.

(21) Appl. No.: 12/311,107

(22) PCT Filed: Sep. 25, 2007

(86) PCT No.: PCT/JP2007/068508

§ 371 (c)(1),
(2), (4) Date: Mar. 19, 2009

(87) PCT Pub. No.: WO2008/038612

PCT Pub. Date: Apr. 3, 2008

(65) Prior Publication Data

US 2010/0039041 A1 Feb. 18, 2010

(30) Foreign Application Priority Data

Sep. 29, 2006 (JP) ..... 2006-269506

(51) Int. Cl.
*H01J 65/04* (2006.01)

(52) U.S. Cl. ..... 313/161; 313/153; 313/155; 313/637; 313/639; 315/62; 315/117; 315/248

(58) Field of Classification Search ..... 315/57, 315/62, 117, 248; 313/572, 573, 574, 575, 313/631, 634, 636, 153–162
See application file for complete search history.

(56) References Cited

U.S. PATENT DOCUMENTS 4,298,828 A * 11/1981 Justice et al. ..... 315/248
(Continued)

FOREIGN PATENT DOCUMENTS

EP 1868227 12/2007
(Continued)

OTHER PUBLICATIONS

International Search Report mailed Oct. 23, 2007, issued on PCT/JP2007/068508.

*Primary Examiner* — Douglas W Owens
*Assistant Examiner* — Thai Pham
(74) *Attorney, Agent, or Firm* — Edwards Wildman Palmer LLP; James E. Armstrong, IV; David J. Silvia

(57) ABSTRACT

The electrodeless discharge lamp comprises: a bulb provided with a substantially-spherical spherical portion and a neck portion extending from the spherical portion; a base connected to the neck portion; a protrusion formed at an apex of the spherical portion; and an induction coil that causes light emission by discharge developed in the bulb. The electrodeless discharge lamp satisfies the formula below:

$t-6\square 10959\times X+25\square t+6$ (Formula)

where $X=(B\times S)/(L\times A)$, $B=W/(4\times\pi\times(D/20)^2)$, $S=qj\pi\times(d/20)^2$, $L=\pi\times(d/10)$, W (W) denotes the lamp input power, D (mm) denotes the diameter of the spherical portion, d (mm) denotes the diameter of a portion at a joint surface between the neck portion and the base, and A (mm) denotes the distance from a largest-diameter portion of the spherical portion to the joint surface, and t is the temperature (° C.) at the tip of the protrusion during downward stable lighting of the electrodeless discharge lamp.

4 Claims, 4 Drawing Sheets

U.S. PATENT DOCUMENTS

| | | | | |
|---|---|---|---|---|
| 5,581,157 | A * | 12/1996 | Vrionis | 315/117 |
| 5,723,947 | A * | 3/1998 | Popov et al. | 313/634 |
| 6,051,922 | A | 4/2000 | Schlejen et al. | |
| 6,979,940 | B2 * | 12/2005 | Kurachi et al. | 313/46 |
| 2005/0057186 | A1 * | 3/2005 | Kurachi et al. | 315/248 |
| 2006/0103314 | A1 * | 5/2006 | Chandler et al. | 313/634 |

FOREIGN PATENT DOCUMENTS

| | | |
|---|---|---|
| JP | 06-005006 | 1/1994 |
| JP | 07-272688 | 10/1995 |
| JP | 2001-325920 | 11/2001 |
| JP | 2005-346983 | 12/2005 |
| WO | WO-2006/101153 | 9/2006 |

* cited by examiner

PS-TYPE BULB

A-TYPE BULB

ELECTRODELESS DISCHARGE LAMP, LIGHTING FIXTURE, AND METHOD FOR MANUFACTURING ELECTRODELESS DISCHARGE LAMP

TECHNICAL FIELD

The present invention relates to an electrodeless discharge lamp in which a bulb having a noble gas and a light-emitting material both sealed therein has no electrodes, and light is emitted through discharge in the bulb by applying, to the bulb, a high-frequency electromagnetic field generated through flow of high-frequency current in an induction coil, and relates to a lighting fixture using the electrodeless discharge lamp, and to a method for manufacturing the electrodeless discharge lamp.

BACKGROUND

Electrodeless discharge lamps comprise a bulb and an induction coil. The bulb has a noble gas and a light-emitting material both sealed therein. Examples of electrodeless fluorescent lamps include, for instance, lamps in which an induction field, generated by a high-frequency current flowing through an induction coil, causes discharge in a bulb, exciting thereby mercury as a light-emitting material. The ultraviolet radiation from the excited mercury atoms strikes then a phosphor, whereupon the ultraviolet radiation is converted into visible light. The structure of such electrodeless discharge lamps comprises no electrodes inside the lamp. Therefore, such lamps are not subject to defective lightning caused by electrode deterioration, and boast a longer life than ordinary fluorescent lamps.

A bismuth-indium amalgam is used as the supply source of mercury vapor in the electrodeless discharge lamps disclosed in Japanese Patent Application Laid-open No. H7-272688 and Japanese Utility Model Application Laid-open No. H6-5006. Such amalgams are advantageous in that they afford high light output over a wide range of surrounding temperature. However, a high amalgam temperature is required in order to release the necessary mercury vapor for realizing high light output, and it takes time to reach the required temperature. Long rise times are thus a shortcoming of such amalgams. Some results show that, when using a bismuth-indium amalgam, it takes about one minute to secure 60% light output relative to light output during stable lighting.

By contrast, Japanese Patent Application Laid-open No. 2001-325920 (hereinafter, Patent document 1) discloses an electrodeless discharge lamp in which pure mercury (mercury droplets) are used instead of an amalgam, with a view to shortening the rise time. The above document discloses that 50% of maximum output is reached within 2 to 3 seconds after starting the lamp. The reason for this is that mercury droplets afford high mercury vapor pressure at a lower temperature than in the case of an amalgam, so that the time that it takes to reach a required temperature is shorter. However, bulb temperature rises when input power relative to bulb volume is substantial, and/or when the surrounding temperature is high. The mercury vapor pressure becomes then excessively high as a result, causing light output to drop. In the above document the mercury vapor pressure is controlled to an appropriate value by providing a protrusion, as a coldest spot, in the bulb.

When using mercury droplets as the form in which mercury is sealed in the lamp, it is difficult to manage the amount of mercury sealed in, and thus mercury may become sealed in the lamp in an amount greater than required. The amount of mercury sealed in the lamp must be as small as possible, both in terms of environmental protection and in order to prevent light output blocking on account of adhesion to the phosphor surface. To address these shortcomings, Japanese Patent Application Laid-open No. 2005-346983 (hereinafter, Patent document 2), for instance, discloses the features of providing a protrusion, as a coldest spot, on a bulb, and using a Zn—Hg amalgam as the form in which mercury is sealed in the lamp.

As described above, Patent documents 1 and 2 disclose known methods of obtaining high light output by providing a protrusion on a bulb and by controlling mercury vapor pressure to an appropriate value. When the lit bulb is facing downwards (namely at an orientation such that the base disposed in the bulb is arranged facing up), the protrusion stands at the location on the surface of the bulb that is at a lowest temperature, i.e. the protrusion becomes the coldest spot. The mercury vapor pressure in the bulb is determined by the temperature of the coldest spot, while the light output of the lamp is governed by the mercury vapor pressure in the bulb. Therefore, the mercury vapor pressure in the bulb can be optimized, and hence the light output of the lamp can be optimized, by providing a protrusion in the bulb and by controlling the temperature of the coldest spot.

The protrusion becomes thus the coldest spot when the bulb is lit facing downward. Therefore, the temperature of the coldest spot can be regulated (controlled) by modifying the diameter and/or height of the protrusion. When the bulb is lit facing upward (namely at an orientation such that the base disposed in the bulb is arranged facing up), however, the temperature of the protrusion rises by virtue of its being disposed at the top of the bulb, so that the protrusion becomes no longer the coldest spot. When the bulb is lit facing upward, therefore, light output may drop, since the temperature of the coldest spot cannot be now controlled by way of the protrusion. Further, the output may vary depending on the lighting direction of the lamp.

DISCLOSURE OF THE INVENTION

With a view to solving the above problems, it is an object of the present invention to provide an electrodeless discharge lamp that allows obtaining a constant light output regardless of the lighting direction, and to provide a lighting fixture using the electrodeless discharge lamp, as well as a method for manufacturing the electrodeless discharge lamp.

The electrodeless discharge lamp of the present invention comprises: a bulb made of a light-transmitting material, having a noble gas and mercury both sealed therein, and provided with a substantially-spherical spherical portion and a neck portion extending from the spherical portion; a base connected to the neck portion; a protrusion that is formed at an apex of the spherical portion, which is on an opposite side to the neck portion, and that protrudes out of the spherical portion; and an induction coil is supplied with a high-frequency current to apply an electromagnetic field to the bulb, and said electromagnetic field triggering discharge in the bulb to cause light emission. In the above-described electrodeless discharge lamp, when defining the relations $B=W/(4\times\Pi\times(D/20)^2)$, $S=\Pi\times(d/20)^2$, $L=\Pi\times(d/10)$, $X=(B\times S)/(L\times A)$, where W (W) denotes the lamp input power, D (mm) denotes the diameter of the spherical portion, d (mm) denotes the diameter of a portion at a joint surface between the neck portion and the base, and A (mm) denotes the distance from a largest-diameter portion of the spherical portion to the joint surface, then the electrodeless discharge lamp satisfies the formula below:

$$t-6\leqq 10959\times X+25\leqq t+6 \quad \text{(Formula A)}$$

where t is the temperature (° C.) at the tip of the protrusion during downward stable lighting of the electrodeless discharge lamp.

The inventors found that, upon defining X as above, there exists a correlation given by formula (B) below between X and the temperature T (° C.) of the coldest spot during upward stable lighting $$T=10959\times X+25 \quad \text{(Formula B)}$$

Therefore, the value of X for equalizing the temperature of the coldest spot during upward stable lighting with the temperature of the coldest spot during downward stable lighting (i.e. the temperature at the tip of the protrusion) is determined by substituting in formula B the temperature t at the tip of the protrusion, during downward stable lighting, for the temperature T.

In consideration of, for instance, variability among articles, it was found that when X satisfies (formula A) above the temperature of the coldest spot during upward stable lighting can be made substantially the same as the temperature of the coldest spot during downward stable lighting.

Therefore an electrodeless discharge lamp designed so as to satisfy formula (A) above allows obtaining a constant light output regardless of the lighting direction.

Preferably, the temperature t at the tip of the protrusion ranges from 30° C. to 50° C. Such a temperature range allows optimizing the mercury vapor pressure in the bulb during stable lighting and allows achieving high light output.

The present invention provides also a lighting fixture comprising the above electrodeless discharge lamp and a lighting circuit for supplying a high-frequency current to the electrodeless discharge lamp. This lighting fixture allows obtaining a constant light output regardless of the lighting direction.

The present invention provides further a method for manufacturing (method for designing) the above electrodeless discharge lamp. This manufacturing method comprises the following steps (a) to (c):

(a) defining the relations:

$$B=W/(4\times\Pi\times(D/20)^2),$$

$$S=\Pi\times(d/20)^2,$$

$$L=\Pi\times(d/10),$$

$$X=(B\times S)/(L\times A) \quad \text{(Formula C)}$$

where W (W) denotes the lamp input power, D (mm) denotes the diameter of the spherical portion, d (mm) denotes the diameter of a portion at a joint surface between the neck portion and the base, and A (mm) denotes the distance from a largest-diameter portion of the spherical portion to the joint surface;

(b) obtaining an X that satisfies $$t-6\leqq 10959\times X+25\leqq t+6,$$

where t is the temperature (° C.) at the tip of the protrusion during downward stable lighting of the electrodeless discharge lamp; and (c) determining, in the (Formula C) of step (a), the lamp input power W, the diameter D of the spherical portion, the diameter d of the portion of the joint surface and the distance A from a largest-diameter portion of the spherical portion to the joint surface, such that X takes on a value obtained in step (b).

This manufacturing method allows realizing an electrodeless discharge lamp in which constant light output can be obtained regardless of the lighting direction.

BEST MODE FOR CARRYING OUT THE INVENTION

Figure 1:
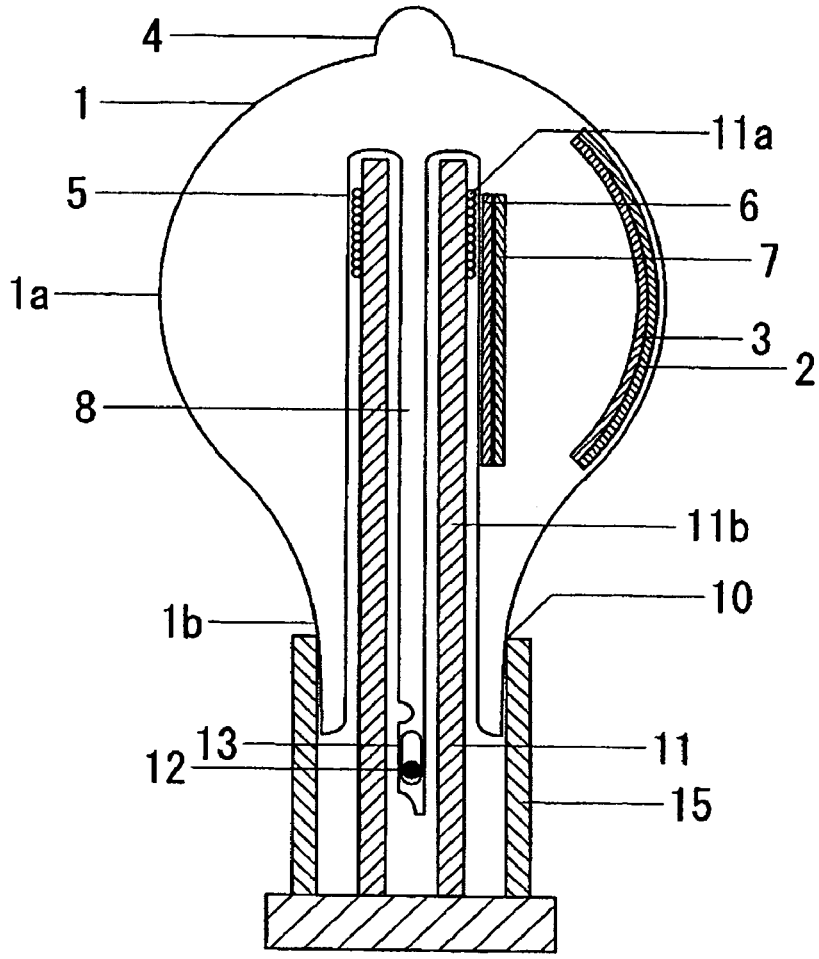
FIG. 1 is a schematic cross-section diagram of an electrodeless discharge lamp according to an embodiment of the present invention.
Figure 2:
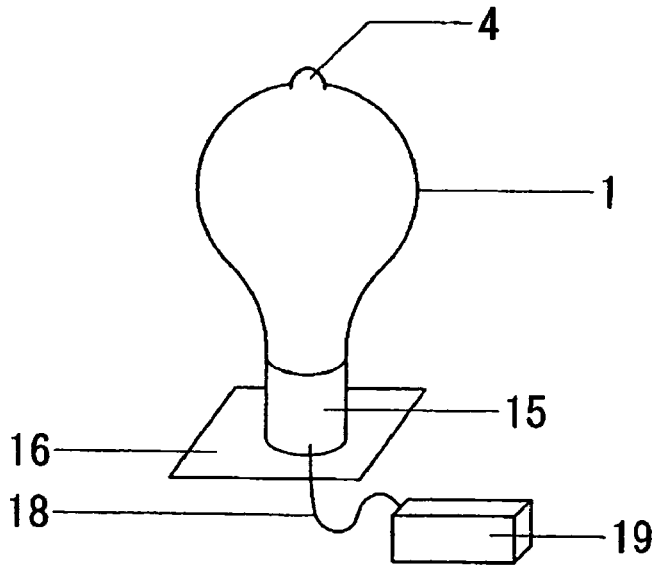
FIG. 2 is a perspective-view of a lighting fixture using the electrodeless discharge lamp of FIG. 1.

FIG. 1 illustrates a cross-sectional diagram of an electrodeless discharge lamp of the present embodiment. FIG. 2 illustrates a schematic diagram of a lighting fixture comprising the lamp of the present embodiment.

The electrodeless discharge lamp comprises a bulb 1 formed of a light-transmitting material such as glass and having sealed inside mercury and a noble gas such as argon or krypton.

The bulb 1, which is hermetically sealed, comprises a substantially-spherical spherical portion 1*a*; a neck portion 1*b* extending from the spherical portion 1*a*; a cavity 5 extending from the neck portion 1*b* into the spherical portion 1*a* and having inserted therein a below-described coupler 11; and an exhaust fine tube 8 disposed inside the cavity 5, facing from the bottom of the cavity 5 toward an opening of the cavity.

A protrusion 4 is formed on the apex of the spherical portion 1*a*, protruding out of the latter, on the opposite side to the neck portion 1*b*, i.e. on the upper end of the spherical portion 1*a* in FIG. 1.

The inner faces of the bulb 1 and the protrusion 4 are coated with a phosphor film 3 and a protective film 2 comprising a metal oxide such as $Al_2O_3$ or $SiO_2$ (only part of these films are shown in the figure). Likewise, the peripheral wall of the cavity 5 is coated with a protective film 6 and a phosphor film 7 (only part of these films are shown in the figure).

A container 13 comprising an alloy of iron and nickel is housed inside the exhaust fine tube 8. In the container 13 there is sealed Zn—Hg 12 for releasing mercury.

A base 15 made of a resin material or the like is connected to the neck portion 1*b*.

The coupler 11 comprises an induction coil 11*a* for generating an induction field, a ferrite core (not shown) through which there passes the magnetic flux generated by the induction coil 11*a*, and a substantially tubular heat conductor 11*b* for dissipating the heat generated by the induction coil 11*a* and the ferrite core. The coupler 11 is fitted into the base 15, in such a manner that when the base 15 is connected to the neck portion 1*b*, the coupler 11 becomes inserted into the cavity 5. The exhaust fine tube 8 becomes then disposed inside the heat conductor 11*b*.

As illustrated in FIG. 2, a lighting circuit 19 which flows high-frequency current to the induction coil 11*a* is connected to the base 15 via an output wire 18, to make up thereby a lighting fixture. The lighting circuit 19 supplies high-frequency current to the induction coil 11*a* of the coupler 11 via the base 15. Input power to the induction coil 11*a* is adjusted by intermittently changing the operating frequency. A heat-dissipating plate 16 is provided under the base 15, with a view to preventing the temperature of the bulb 1 from rising when the lamp is lit up.

An induction field is generated around the induction coil 11*a* of the coupler 11 when high-frequency current flows into the induction coil 11*a*. This induction field accelerates electrons in the bulb 1. Electron collisions give rise thereupon to ionization and discharge. Mercury atoms are excited during discharge. The excited mercury atoms emit UV rays as they return to their ground state. Upon striking the phosphor film 3 that coats the inner wall of the bulb 1 and the phosphor film 7 that coats the peripheral wall of the cavity 5, these UV rays are converted into visible light. The visible light thus converted is emitted outwards through the bulb 1.

The light output of the lamp is governed by the mercury vapor pressure in the bulb. In turn, the mercury vapor pressure in the bulb is controlled by the temperature of the coldest spot of the bulb. When the lamp is lit with the bulb 1 facing downward (i.e. with the protrusion 4 facing downward), the protrusion 4 becomes the coldest spot during stable lighting (hereinafter "during downward stable lighting). Therefore, the mercury vapor pressure in the bulb, and thus the lamp output during downward stable lighting, can be optimized by designing the diameter and the height of the protrusion 4 in such a manner that the temperature at the tip of the protrusion is optimal during downward stable lighting.

However, when the lamp is lit with the bulb 1 facing upward (i.e. with the protrusion 4 facing upward) as illustrated in FIG. 2, the temperature of the lit bulb 1 rises on account of discharge heat during stable lighting (hereinafter "during upward stable lighting") The temperature at the top of the bulb (on the side of the protrusion 4) becomes higher than the temperature of the bottom of the bulb (on the side of the base 15) owing to convection in the bulb, and thus the protrusion 4 becomes no longer the coldest spot.

The inventors measured the surface temperature of the bulb 1 in the vicinity of the base 15, which is disposed at the bottom of the bulb, during upward stable lighting. The results revealed that the coldest spot appears in the vicinity of the joint surface 10 between the neck portion 1*b* and the base 15 (that is, the portion at which the neck portion 1*b* curves out of the base 15 and comes into contact with air). This appears to result from that the portion of the bulb inside of the base preserves its surface temperature. During upward stable lighting, therefore, the joint surface 10 becomes the spot portion that controls the mercury vapor pressure in the bulb 1.

Figure 3:
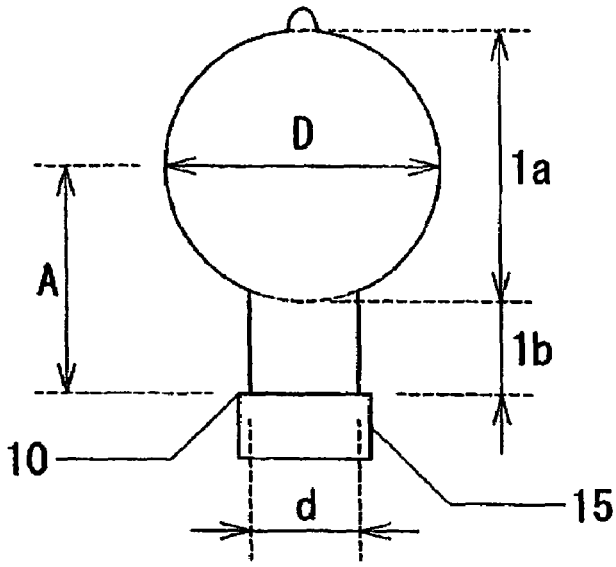
FIG. 3 is an explanatory diagram for explaining the shape of the electrodeless discharge lamp of FIG. 1.

The temperature of the joint surface 10 changes depending on, for instance, the input power to the lamp, the shape of the bulb, the dimensions of the bulb and the dimensions of the joint surface. The design factors in the temperature of the joint surface, which becomes the coldest spot during upward stable lighting, are explained next based on FIG. 3. For the sake of clarity, the following explanation is made with reference to a G-type bulb as set forth in JIS C7710.

The bulb can be broadly divided into the substantially-spherical spherical portion 1*a* and the neck portion 1*b* that is connected to the base 15. The inventors extracted, as design factors, the diameter D (mm) of the spherical portion 1*a*, the diameter d (mm) of the portion at the joint surface 10 between the neck portion 1*b* and the base 15, and the distance A (mm) from the largest-diameter portion of the spherical portion 1*a* to the joint surface 10, and manufactured various lamps changing the values of these design factors. These lamps were evaluated by being lit, in an upward state, using various lamp inputs. The results are illustrated in FIG. 4.

Figure 4:
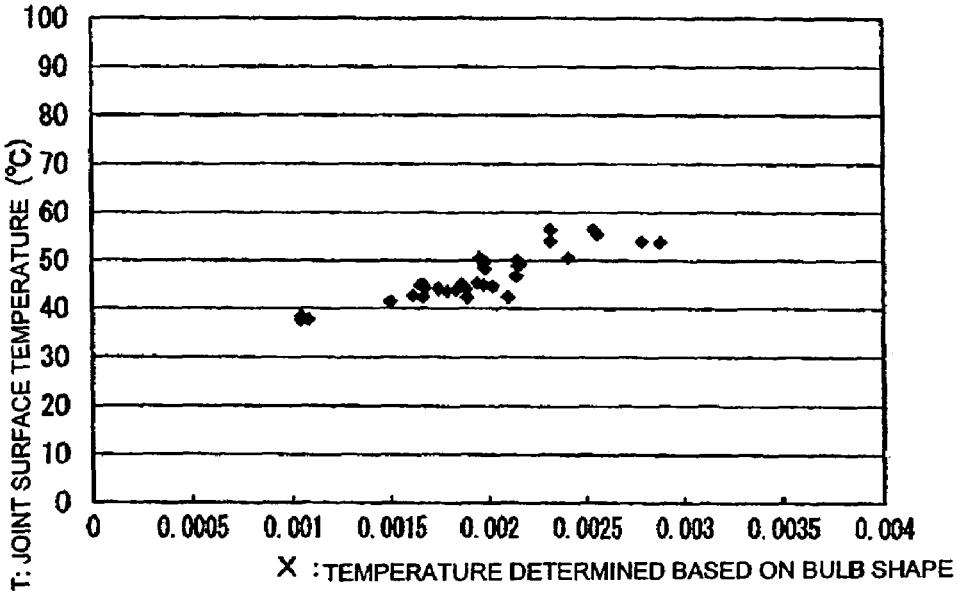
FIG. 4 is a diagram illustrating experimental results of the electrodeless discharge lamp of FIG. 1.

In FIG. 4, T in the axis of ordinate represents the temperature of the joint surface 10 (temperature of the coldest spot) at an ambient temperature of 25° C. To identify the coldest spot, there were measured temperatures at various portions of the bulb other than the temperature of the joint surface 10. The temperature of the joint surface 10 was confirmed to be that of the coldest spot.

In the axis of abscissa, X represents a value determined by the shape of the bulb and the lamp input, which the inventors defined as $$X=(B\times S)/(L\times A) \quad \text{(Formula 1)}$$

In the formula, B is the pseudo bulb wall loading (W/cm.$^2$) obtained by dividing the lamp input power W (W) by the pseudo bulb surface area (surface area of a sphere of diameter D), B being defined as $B=W/(4\times\Pi\times(D/20)^2)$. Further, S is the cross-sectional area (cm.sup.2) of the joint surface 10, defined as $S=\Pi\times(d/20)^2$. L is the outer perimeter length of the joint surface 10, defined as $L=\Pi\times(d/10)$.

Figure 5:
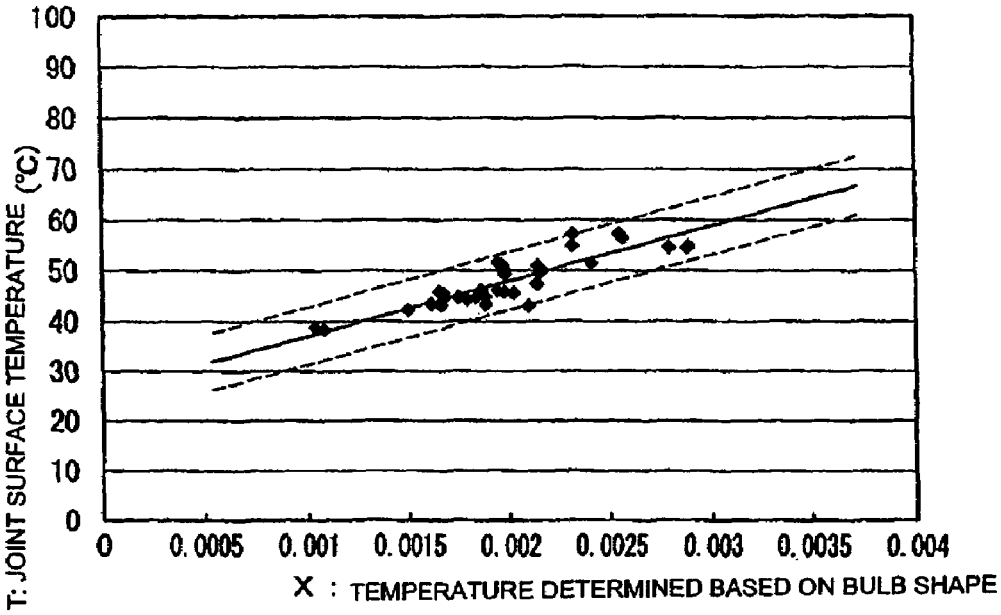
FIG. 5 is a diagram depicting the experimental results of FIG. 4.

The results in FIG. 4 show that there exists a correlation between the value X defined by the bulb shape and the lamp input, and the temperature T of the joint surface 10, which becomes the coldest spot during upward stable lighting. When worked out, as in FIG. 5, the correlation can be expressed as formula 2 below.

$$T=10959X+25 \quad \text{(Formula 2)}$$

Formula 2 allows determining the value of X for realizing a desired coldest spot temperature T during upward stable lighting. The value of X for which the temperature of the coldest spot during upward stable lighting is the same as the temperature of the coldest spot during downward stable lighting can be determined by substituting in formula 2 the temperature t at the tip of the protrusion 4, during downward stable lighting, for the temperature T.

In consideration of, for instance, variability among articles, it is found that the temperature of the coldest spot during upward stable lighting can be made substantially the same as the temperature of the coldest spot during downward stable lighting when X satisfies formula 3 below.

$$t-6\leqq 10959\times X+25\leqq t+6 \quad \text{(Formula 3)}$$

wherein t (.degree. C.) is the temperature at the tip of the protrusion during downward stable lighting, and T varies within a range $t-6\leqq T\leqq t+6$ derived from FIG. 5.

The factors contributing to X are the lamp input power W (W), the diameter D (mm) of the spherical portion 1*a*, the diameter d (mm) of the portion at the joint surface 10 and the distance A (mm) from the largest-diameter portion of the spherical portion 1*a* to the joint surface 10. Therefore, the temperature of the coldest spot during upward stable lighting (i.e. the temperature of the joint surface 10) can be made substantially the same as the temperature of the coldest spot during downward stable lighting (i.e., the temperature at the tip of the protrusion 4) by defining the lamp input power W, the diameter D of the spherical portion 1*a*, the diameter d of the portion at the joint surface 10 and the distance A from the largest-diameter portion of the spherical portion 1*a* to the joint surface 10 in such a manner that X takes on a value obtained on the basis of (Formula 3). As a result there can be realized an electrodeless discharge lamp that allows obtaining a constant light output without changing the luminous flux value depending on the lighting direction.

There exist numerous combinations of X that satisfy Formula 3. The lamp input power W and the diameter D of the spherical portion are determined in accordance with the specifications of the lamp and/or the lamp type (for instance, G-type, P-type or A-type). The remaining variables are then the diameter d of the portion at the joint surface (mm) and the distance A (mm), so that X is determined by defining the diameter d of the portion at the joint surface (mm) and the distance A (mm). The diameter of the cavity 5 and the diameter d of the portion at the joint surface are in turn set in accordance with the size of the coupler 11. The distance A becomes determined thereby.

In the above step there can be realized an electrodeless discharge lamp in which the temperature of the coldest spot during upward stable lighting is substantially the same as the temperature of the coldest spot during downward stable lighting by defining the lamp input power W, the diameter D of the spherical portion 1*a*, the diameter d of the portion at the joint surface 10 and the distance A from the largest-diameter portion of the spherical portion 1*a* to the joint surface 10, in such a manner that X takes on a value obtained on the basis of formula 3.

As described above, the temperature of the coldest spot (protrusion 4) during downward stable lighting can be controlled (regulated) by regulating the diameter and/or height of the protrusion 4. The temperature of the coldest spot ranges preferably from 30° C. to 50° C. in order to optimize the mercury vapor pressure in the bulb. Therefore, by determining X through Formula 3 using a temperature t, at the tip of the protrusion, ranging from 30° C. to 50° C., an electrodeless discharge lamp can be realized that affords high light output, regardless of the lighting direction.

The effect of the present invention is explained next on the basis of examples and comparative examples.

Examples

A protrusion having a height of 25 (mm) was provided on an A-type bulb having a spherical portion the diameter D of which was 160 (mm). The lamp input power W (W) was 150 (W), and the lamp was lit facing downward. The temperature at the tip of the protrusion 4 during stable lighting was 40° C.

Upon determining X on the basis of formula (3) above for a temperature of 40.degree. C. at the tip of the protrusion during downward stable lighting, there was obtained $$0.00082 \leqq X \leqq 0.001920$$

Firstly, a lamp was manufactured having the diameter d (mm) of the portion at the joint surface 10 and the distance A (mm) from the largest-diameter portion of the spherical portion 1*a* to the joint surface 10 in such a manner that that X was 0.00082. Herein, the diameter d of the portion at the joint surface 10 was 50 (mm), depending on the size of the coupler 11, and the distance A (mm) was determined in such a manner that X was 0.00082. The manufactured lamp was lit facing upwards with a lamp input power W (W) of 150 (W).

As a result there was obtained a luminous flux of 96.3% during upward stable lighting, for a 100% luminous flux during downward stable lighting.

A luminous flux of 96.8% during upward stable lighting was obtained when the lamp was manufactured so that X was 0.00192.

Comparative Example

A lamp was manufactured under the same conditions as in the above example, but in such a manner that X was 0.0007. As a result there was obtained a luminous flux of 93.8% during upward stable lighting.

Similarly, a luminous flux of 94.4% during upward stable lighting was obtained when the lamp was manufactured so that X was 0.002.

It was found that the further X deviates from the above range, the wider becomes the difference in light intensity depending on the lighting direction.

As describe in the above, the difference between luminous flux values during upward stable lighting and downward stable lighting can be kept no greater than 5%, and that an electrodeless discharge lamp having high light output can be realized, regardless of the lighting direction, by manufacturing a lamp in such a manner so as to satisfy formula 3 above.

Figure 6A:
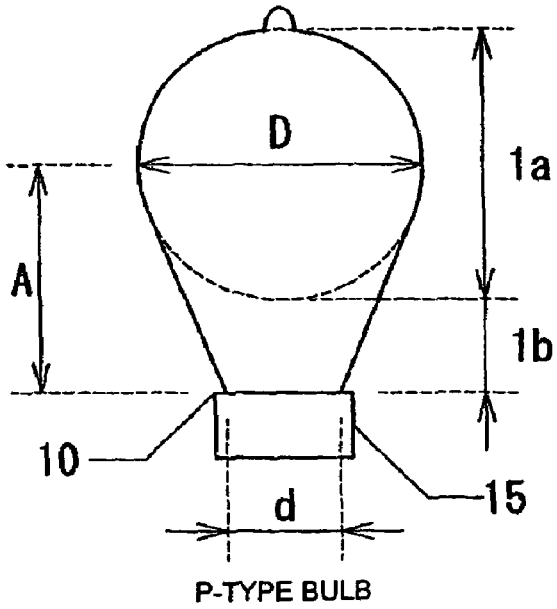
FIG. 6A is a diagram for explaining another bulb having a shape different from that of FIG. 3.
Figure 6B:
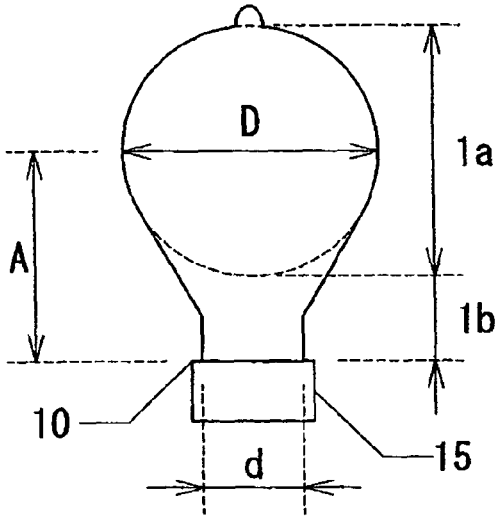
FIG. 6B is a diagram for explaining another bulb having a shape different from that of FIG. 3.
Figure 6C:
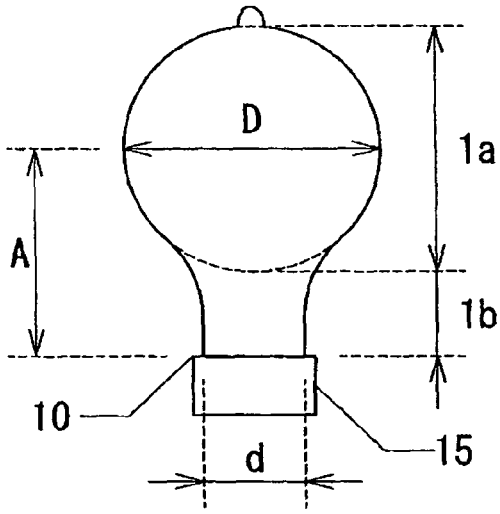
FIG. 6C is a diagram for explaining another bulb having a shape different from that of FIG. 3.

Needless to say, the bulb shapes for which the above formula applies are not limited to the shapes illustrated in the present embodiment, the formula being effective for bulbs comprising a substantially-spherical spherical portion. Examples of bulbs having other shapes and provided with a substantially-spherical spherical portion include, for instance, P-type, PS-type and A-type bulbs according to JIS C7710, illustrated in FIGS. 6A to 6C. All such bulbs can be designed so that the temperature of the coldest spot during upward stable lighting is substantially the same as the temperature at the tip of the protrusion during downward stable lighting, as in the above embodiment.

Figure 7:
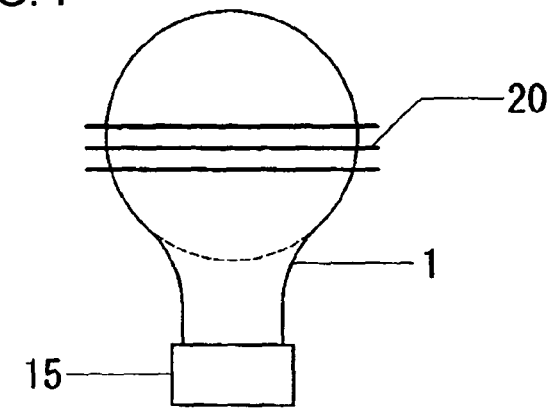
FIG. 7 is a schematic diagram of an outer coil-type electrodeless discharge lamp in which the present invention can be used.

To explain the present embodiment there has been used an inner coil-type electrodeless discharge lamp in which a coupler 11 is inserted into a recessed cavity 5 provided in the bulb. Needless to say, however, the present invention can also be used in an outer coil-type electrodeless discharge lamp in which an induction coil 20 is provided outside the bulb, as illustrated in FIG. 7.

It is thus obvious that the above embodiments can be subject to numerous modifications without departing from the technical scope of the present invention. Other than for the limitations set forth in the claims, therefore, the present invention is not limited to any specific embodiments thereof.

The invention claimed is:

1. An electrodeless discharge lamp, comprising:

a bulb made of a light-transmitting material, having a noble gas and mercury sealed therein, and provided with a spherical portion and a neck portion extending from said spherical portion;

a base connected to said neck portion;

a protrusion that is formed at an apex of said spherical portion, which is on an opposite side to said neck portion, and that protrudes out of said spherical portion; and an induction coil is supplied with a high-frequency current to apply an electromagnetic field to the bulb, and said electromagnetic field triggering discharge in the bulb to cause light emission, wherein when defining the relations:

$$B = W/(4 \times \pi \times (D/20)^2),$$

$$S = \pi \times (d/20)^2,$$

$$L = \pi \times (d/10),$$

$$X = (B \times S)/(L \times A),$$

where W (W) denotes the lamp input power, D (mm) denotes the diameter of said spherical portion, d (mm) denotes the diameter of a portion at a joint surface between said neck portion and said base, and A (mm) denotes the distance from a largest-diameter portion of said spherical portion to said joint surface, the electrodeless discharge lamp is formed in such a manner that "X" takes on a value obtained on the basis of the (Formula) below:

$$t-6 \leqq 10959 \times X+25 \leqq t+6 \quad \text{(Formula)}$$

where t is the temperature (° C.) at the tip of said protrusion during downward stable lighting of the electrodeless discharge lamp, so that the electrodeless discharge lamp is allowed to obtain a constant light output without changing the luminous flux value depending on the lighting direction, and wherein the electrodeless discharge lamp is configured that the temperature of the coldest spot of the bulb during upward stable lighting is substantially the same as the temperature of the coldest spot of the bulb during downward stable lighting.

2. The electrodeless discharge lamp according to claim 1, wherein the temperature t at the tip of said protrusion ranges from 30° C. to 50° C.

3. A lighting fixture, comprising the electrodeless discharge lamp according to claim 1, and a lighting circuit for supplying a high-frequency current to said electrodeless discharge lamp.

4. A method for manufacturing an electrodeless discharge lamp, the electrodeless discharge lamp comprising:

a bulb made of a light-transmitting material, having a noble gas and mercury sealed therein, and provided with a spherical portion and a neck portion extending from said spherical portion;

a base connected to said neck portion;

a protrusion that is formed at an apex of said spherical portion, which is on an opposite side to said neck portion, and that protrudes out of said spherical portion; and an induction coil is supplied with a high-frequency current to apply an electromagnetic field to the bulb, and said electromagnetic field triggering discharge in the bulb to cause light emission, the method comprising the steps of:

(a) defining the relations:

$$B=W/(4\times\pi\times(D/20)^2),$$

$$S=\pi\times(d/20)^2,$$

$$L=\pi\times(d/10),$$

$$X=(B\times S)/(L\times A) \quad \text{(Formulas)},$$

where W (W) denotes the lamp input power, D (mm) denotes the diameter of said spherical portion, d (mm) denotes the diameter of a portion at a joint surface between said neck portion and said base, and A (mm) denotes the distance from a largest-diameter portion of said spherical portion to said joint surface;

(b) obtaining an X in such a manner that "X" takes on a value obtained on the basis of the (Formula) below:

$$t-6 \leqq 10959 \times X+25 \leqq t+6 \quad \text{(Formula)},$$

where t is the temperature (° C.) at the tip of said protrusion during downward stable lighting of the electrodeless discharge lamp, so that the electrodeless discharge lamp is allowed to obtain a constant light output without changing the luminous flux value depending on the lighting direction; and (c) determining, in said (Formulas) of step (a), said lamp input power W, said diameter D of said spherical portion, said diameter d of said portion at said joint surface and the distance A from a largest-diameter portion of said spherical portion to said joint surface, such that X takes on a value obtained in step (b), wherein the electrodeless discharge lamp is configured that the temperature of the coldest spot of the bulb during upward stable lighting is substantially the same as the temperature of the coldest spot of the bulb during downward stable lighting.

* * * * *